US006090314A

United States Patent [19]

Handa et al.

[11] Patent Number: 6,090,314

[45] Date of Patent: Jul. 18, 2000

[54] ORGANIC POSITIVE TEMPERATURE COEFFICIENT THERMISTOR

[75] Inventors: Tokuhiko Handa; Yukie Yoshinari, both of Tokyo, Japan

[73] Assignee: TDK Corporation, Tokyo, Japan

[21] Appl. No.: 09/238,918

[22] Filed: Jan. 28, 1999

[30] Foreign Application Priority Data

Jun. 18, 1998 [JP] Japan ..... 10-188208

[51] Int. Cl.[7] ..... H01B 1/06; H01C 7/10

[52] U.S. Cl. ..... 252/511; 252/513; 252/514; 338/22 R; 338/25

[58] Field of Search ..... 252/511–514; 338/22 R, 25, 225 D

[56] References Cited

U.S. PATENT DOCUMENTS

| | | | |
|---|---|---|---|
| 3,243,753 | 3/1966 | Kohler | 338/31 |
| 3,351,882 | 11/1967 | Kohler et al. | 338/322 |
| 5,378,407 | 1/1995 | Chandler et al. | 252/513 |
| 5,945,034 | 8/1999 | Handa et al. | 252/511 |
| 5,982,271 | 11/1999 | Handa et al. | 338/22 |

FOREIGN PATENT DOCUMENTS

| | | |
|---|---|---|
| 61-181859 | 8/1986 | Japan . |
| 5-47503 | 2/1993 | Japan . |
| 10-214705 | 8/1998 | Japan . |

*Primary Examiner*—Yogendra Gupta
*Assistant Examiner*—D. G. Hamlin
*Attorney, Agent, or Firm*—Oblon, Spivak, McClelland, Maier & Neustadt, P.C.

[57] ABSTRACT

The organic positive temperature coefficient thermistor of the invention comprises a polyalkylene oxide, a water-insoluble organic compound and conductive particles having spiky protuberances, and so can operate at less than 100° C. that is harmless to the human body, with low initial resistance in a non-operating state (at room temperature), and a large rate of resistance change upon transition from the non-operating state to an operating state, and improved humidity resistance.

12 Claims, 9 Drawing Sheets

ORGANIC POSITIVE TEMPERATURE COEFFICIENT THERMISTOR

BACKGROUND OF THE INVENTION

1. Prior Art

The present invention relates generally to an organic positive temperature coefficient thermistor, and more specifically to an organic positive temperature coefficient thermistor having PTC (positive temperature coefficient of resistivity) behavior or performance that its resistance value increases drastically with increasing temperature.

2. Background Art

An organic positive temperature coefficient thermistor having PTC performance, wherein conductive particles such as carbon powders, e.g., carbon black or graphite powders, and metal powders are milled with and dispersed in a crystalline polymer, has been well known in the art, as typically disclosed in U.S. Pat. Nos. 3,243,753 and 3,351,882. The increase in the resistance value is thought as being due to the expansion of the crystalline polymer upon melting, which in turn cleaves a current-carrying path formed by the conductive fine particles.

An organic positive temperature coefficient thermistor can be used as a self control heater, an overcurrent-protecting element, and a temperature sensor. Requirements for these are that the initial resistance value is sufficiently low at room temperature (in a non-operating state), the rate of change between the initial resistance value and the resistance value in operation is sufficiently large, and the performance is kept stable even upon repetitive operations. For the organic positive temperature coefficient thermistor, it is generally known that since the melting of the crystalline polymer occurs during operation, the dispersion state of the conductive particles varies upon cooling, resulting in an increase in the initial resistance value and a decrease in the rate of resistance change.

In many cases, carbon black has been used as conductive particles in prior art organic positive temperature coefficient thermistors. A problem with carbon black is, however, that when an increased amount of carbon black is used to lower the initial resistance value, no sufficient rate of resistance change is obtainable, and when the amount of carbon black is decreased to obtain a sufficient rate of resistance change, on the contrary, the initial resistance value becomes impractically large. Sometimes, particles of generally available metals are used as conductive particles. In this case, too, it is difficult to arrive at a sensible tradeoff between the low initial resistance value and the large rate of resistance change, as is the case of carbon black.

One approach to solving this problem is disclosed in JP-A 5-47503 that teaches the use of conductive particles having spiky protuberances. More specifically, the publication alleges that polyvinylidene fluoride can be used as a crystalline polymer and spiky nickel powders can be used as conductive particles having spiky protuberances, thereby making a compromise between the low initial resistance value and the large rate of resistance change. However, the thermistor disclosed is found to have insufficient performance stability upon repetitive operations. The operating temperature achieved by use of polyvinylidene fluoride is about 160° C. In applications such as secondary batteries, electric blankets, and protective elements for toilet seats and vehicle sheets, however, an operating temperature of greater than 100° C. poses an immediate danger to the human body. With the safety of the human body in mind, the operating temperature must be less than 100° C., and especially of the order of 60 to 70° C.

U.S. Pat. No. 5,378,407, too, discloses a thermistor comprising filamentary nickel having spiky protuberances, and a polyolefin, olefinic copolymer or fluoropolymer. The publication alleges that the thermistor has low initial resistance and a large rate of resistance change, and its performance stability is well maintained even upon repetitive operations. However, the operating temperatures obtained by high-density polyethylene and polyvinylidene fluoride polymer used in the examples are about 130° C. and about 160° C., respectively. The publication describes that ethylene/ethyl acrylate copolymers, ethylene/vinyl acetate copolymers, ethylene/acrylic acid copolymers, etc., too, may be used. However, the publication does not disclose any example where these polymers are actually used. Although the polymers ensure an operating temperature of less than 100° C., the inventors have already confirmed that the performance of the thermistor become unstable upon repetitive operations.

The thermistor disclosed in U.S. Pat. No. 4,545,926, too, uses spherical Ni, flaky Ni or rod-like Ni, and polyolefins, olefinic copolymers, halogenated vinyl or vinylidene polymers. The examples show that ethylene/ethyl acrylate copolymers and ethylene/acrylic acid copolymers ensure an operating temperature of less than 100° C. while other polymers make the operating temperature greater than 100° C. With the ethylene/ethyl acrylate copolymers and ethylene/acrylic acid copolymers, however, performance becomes unstable upon repetitive operations, as already mentioned.

In JP-A 10-214705, the inventors have already come up with an organic positive temperature coefficient thermistor obtained by milling polyethylene oxide having a weight-average molecular weight of at least 2,000,000 and conductive particles having spiky protuberances, thereby achieving an operating temperature of less than 100° C. and making a compromise between low initial resistance and a large rate of resistance change. This thermistor is found to show excellent PTC performance and have an operating temperature of 60 to 70° C. and low initial resistance in a non-operating state (room temperature), with a sharp resistance rise upon operation, a large rate of resistance change upon transition from the non-operating state to operating state, and stable performance even upon repetitive operations.

However, a problem associated with this thermistor is that its performance becomes unstable in a high-humidity environment. As will be indicated in the examples given later, some considerable degradation is found within as short as 50 hours in humidity resistance testing at 80° C. and 80% RH. The reason is that the polyethylene oxide, because of being soluble in water, adsorbs water or diffuses in the polymer. However, if the thermistor is treated at high temperature to evaporate off water, then it is restored in performance. This indicates that the performance degradation is ascribable to the humidity resistance of the thermistor.

SUMMARY OF THE INVENTION

An object of the invention is to provide an organic positive temperature coefficient thermistor that can operate at less than 100° C. where there is no danger to the human body and has low resistance (at room temperature) in a non-operating state and a large rate of resistance change upon transition from an operating state to a non-operating state as well as an organic positive temperature coefficient thermistor that is also excellent in humidity resistance.

Such an object is achieved by the inventions defined below.

(1) An organic positive temperature coefficient thermistor comprising a polyalkylene oxide (except a polyethylene oxide homopolymer) and conductive particles, each having spiky protuberances.

(2) The organic positive temperature coefficient thermistor according to (1), wherein said polyalkylene oxide is polypropylene oxide or polytetramethylene oxide.

(3) An organic positive temperature coefficient thermistor comprising a polyalkylene oxide, a water-insoluble organic compound and conductive particles, each having spiky protuberances.

(4) The organic positive temperature coefficient thermistor according to (3), wherein said polyalkylene oxide is polyethylene oxide, polypropylene oxide or polytetramethylene oxide.

(5) The organic positive temperature coefficient thermistor according to (3), wherein said water-insoluble organic compound is a low-density polyethylene.

(6) The organic positive temperature coefficient thermistor according to (3), wherein said water-insoluble organic compound is a water-insoluble polymer having a melt flow rate of 0.1 to 30 g/10 min.

(7) The organic positive temperature coefficient thermistor according to (3), wherein said water-insoluble organic compound is a water-insoluble, low-molecular organic compound having a molecular weight of 1,000 or less.

(8) The organic positive temperature coefficient thermistor according to (7), wherein said water-insoluble, low-molecular organic compound has a melting point of 40 to 100° C.

(9) The organic positive temperature coefficient thermistor according to (7), wherein said water-insoluble, low-molecular organic compound is a wax or a compound having a hydrogen-bondable functional group.

(10) The organic positive temperature coefficient thermistor according to (9), wherein said hydrogen-bondable functional group is a carbamoyl or hydroxyl group.

(11) The organic positive temperature coefficient thermistor according to (3), wherein said conductive particles, each having spiky protuberances, are interconnected in a chain form.

(12) The organic positive temperature coefficient thermistor according to (3), which has an operating temperature of less than 100° C.

ACTION

In the present invention, the spiky shape of protuberances on the conductive particles enables a tunnel current to pass readily through the thermistor, and makes it possible to obtain initial resistance lower than would be possible with spherical conductive particles. When the thermistor is in operation, a large resistance change is obtainable because spaces between the spiky conductive particles are larger than those between spherical conductive particles.

In accordance with the present invention wherein the polyalkylene oxide, preferably polyethylene oxide is used, the operating temperature of less that 100° C., preferably 60 to 70° C. is achievable so that a protecting element less dangerous to the human body can be fabricated.

As explained above, the organic thermistor based conductive particles having spiky protuberances and polyethylene oxide can operate at 60 to 70° C. with low initial resistance (at room temperature) in a non-operating state and a large rate of resistance change upon transition from its operating state to its non-operating state. However, this is poor in humidity resistance. According to the present invention, the water-insoluble, low-molecular organic compound is incorporated in the thermistor, whereby its humidity resistance is largely improved while its excellent PTC performance is well maintained.

Even when the polyalkylene oxide (except a polyethylene oxide homopolymer) is used instead of polyethylene oxide, it is possible to obtain a thermistor that can operate at less than 100° C., preferably 60 to 90° C. and more preferably 60 to 70° C. with low initial resistance (at room temperature) in the operating state and a large rate of resistance change upon transition from the non-operating state to the operating state, i.e., shows excellent PTC performance equivalent to that of the organic thermistor based on conductive particles having spiky protuberances and polyethylene oxide. Polyalkylene oxides except polyethylene oxide, too, have generally high water absorption properties because they contain ether bonds and ether oxygen (—O—) therein is susceptible of coordination to water molecules. For this reason, the polyalkylene oxides have low property stability at high humidity although not comparable to polyethylene oxide. By incorporating the water-insoluble organic compound in this organic thermistor based on conductive particles having spiky protuberances and polyalkylene oxide, the thermistor can be greatly improved in terms of humidity resistance while its excellent PTC performance is substantially maintained, as is the case with the thermistor using polyethylene oxide. It is thus possible to minimize degradation in the PTC performance at high humidity.

The great improvement in humidity resistance by the incorporation of the water-insoluble organic compound appears to be due to a microscopic phase-separation structure that the water-absorbing polyalkylene oxide and water-insoluble organic compound form together, in which structure the absorption of water in the polyalkylene oxide or the dispersion of water in the polymer is prevented.

In this regard, JP-A 61-181859 discloses an electrically conductive polymer composition having a positive temperature coefficient of resistivity, characterized by comprising a crystalline polyalkylene oxide, a modified polyolefin having a carboxyl group and/or a carbonic anhydride group in a side chain and/or a main chain, and conductive carbon black and/or graphite. The publication alleges that this construction enables humidity resistance to be improved substantially without detrimental to PTC performance. However, humidity resistance testing was carried out at 40° C. and 90% RH for 240 hours. Such testing conditions are insufficient for determining the humidity resistance of a thermistor in an ordinary environment where it is used. The above accelerating conditions are tantamount to a humidity-depending operating life of 6 months or shorter at Tokyo, and 3 months or shorter at Naha, when calculated on an absolute humidity basis as will be described later. As will be understood from the examples given later, the organic positive temperature coefficient thermistor of the invention has an operating life of at least 500 hours under 80° C. and 80% RH accelerating conditions, i.e., a humidity-depending operating life of 20 years or longer at Tokyo, and 10 years or longer at Naha. In the examples, the publication does not show the properties of thermistors before subjected to the humidity resistance testing; that is, to what degree the thermistors under test degraded remains unclear. Since carbon black and graphite are used as conductive particles, it is impossible to make a compromise between the low initial resistance and the large rate of resistance change, as contemplated in the invention.

EXPLANATION OF THE PREFERRED EMBODIMENTS

Figure 1:
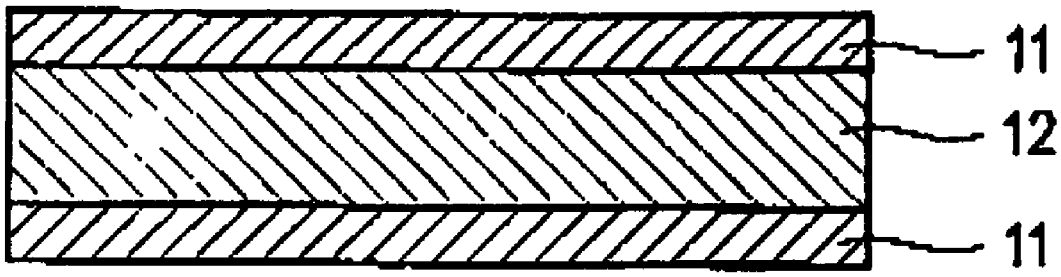
FIG. 1 is a sectional schematic of an organic positive coefficient thermistor sample.

The present invention will now be explained in more detail with reference to some embodiments.

The organic positive temperature coefficient thermistor of the invention is obtained by milling together the polyalkylene oxide (except a polyethylene oxide homopolymer) and the conductive particles having spiky protuberances. Preferably, the polyalkylene oxide and conductive particles having spiky protuberances should be milled together with the water-insoluble organic compound.

The polylakylene oxide used herein, when it is not used in combination with the water-insoluble organic compound, should preferably be any one of polypropylene oxide (PPO), polytrimethylene oxide, polytetramethylene oxide or a copolymer of these oxides, and a copolymer of polyethylene oxide. Preferable copolymers are those of two out of polypropylene oxide (PPO), polytrimethylene oxide, polytetramethylene oxide, and polyethylene oxide. Such copolymers, for instance, include a polyethylene oxide-polypropylene oxide block copolymer. The copolymer may comprise comonomers at any desired ratio. In the invention, it is especially preferable to use polypropylene oxide or polytetramethylene oxide.

The polyalkylene oxide, when used in combination with the water-insoluble organic compound, may be the same as those not used in combination with the water-insoluble organic compound. However, it is preferable to use polypropylene oxide, polytetramethylene oxide, and polyethylene oxide, especially polyethylene oxide (homopolymer). It is especially preferable to use a polyethylene oxide having a weight-average molecular weight of at least 2,000,000 because performance variations upon repetitive operations are critically reduced. Although the reason has yet to be clarified, a possible explanation could be that more uniform dispersion can be achieved due to an improvement in the wettability of the crystalline polymer with respect to the conductive particles, so that variations in the crystallographic state of the crystalline polymer or the dispersion state of the mixture due to heating-and-cooling cycles can be reduced.

The polyethylene oxide with Mw≧2,000,000 has a melting point of about 60 to 70° C. and a density of about 1.15 to 1.22 g/cm$^3$.

When the polyalkylene oxide used herein is a polyethylene oxide homopolymer, it is preferable that the weight-average molecular weight thereof is Mw≧2,000,000, and especially Mw=3,000,000 to 6,000,000. When other polyalkylene oxide is used, it is preferable that the weight-average molecular weight is Mw≧1,000. When Mw is smaller than this, the dispersibility of the conductive particles tends to become worse due to too low a melt viscosity of the polymer, making it difficult to lower the initial resistance of the thermistor (at room temperature) in the non-operating state.

Since the primary object of the invention is to obtain a thermistor having an operating temperature of preferably less than 100° C., it is preferable that the polyalkylene oxide used has a melting point of less than 100° C., especially about 60 to 90° C., and more especially about 60 to 70° C.

The conductive particles used herein, each having spiky protuberances, are each made up of a primary particle having pointed protuberances. More specifically, a number of (usually 10 to 500) conical and spiky protuberances, each having a height of ⅓ to 1/50 of particle diameter, are present on one single particle. The conductive particles are should be made up of metals, especially Ni.

Although such conductive particles may be used in a discrete powder form, it is preferable that they are used in a chain form of about 10 to 1,000 interconnected primary particles to form a secondary particle. The chain form of interconnected primary particles may partially include primary particles. Examples of the former include a spherical form of nickel powders having spiky protuberances, one of which is commercially available under the trade name of INCO Type 123 Nickel Powder (INCO Co., Ltd.). These powders have an average particle diameter of about 3 to 7 μm, an apparent density of about 1.8 to 2.7 g/cm$^3$, and a specific surface area of about 0.34 to 0.44 m$^2$/g.

Preferred examples of the latter are filamentary nickel powders, some of which are commercially available under the trade names of INCO Type 255 Nickel Powder, INCO Type 270 Nickel Powder, INCO Type 287 Nickel Powder, INCO Type 210 Nickel Powder and INCO Type 215 Nickel Powder, all made by INCO Co., Ltd., with the former three being preferred. The primary particles have an average particle diameter of preferably at least 0.1 μm, and more preferably about 0.5 to about 4.0 μm inclusive. Primary particles having an average particle diameter of 1.0 to 4.0 μm inclusive are most preferred, and may be mixed with 50% by weight or less of primary particles having an average particle diameter of 0.1 μm to less than 1.0 μm. The apparent density is about 0.3 to 1.0 g/cm$^3$ and the specific surface area is about 0.4 to 2.5 m$^2$/g. In this regard, it is to be noted that the average particle diameter is measured by the Fischer subsieve method.

Such conductive particles are set forth in JP-A 5-47503 and U.S. Pat. No. 5,378,407.

In addition to the conductive particles having spiky protuberances, it is acceptable to use as the conductive particles for imparting auxiliary conductivity to the thermistor carbon conductive particles such as carbon black, graphite, carbon fibers, metallized carbon black, graphitized carbon black and metallized carbon fibers, spherical, flaky or fibrous metal particles, metal particles coated with different metals (e.g., silver-coated nickel particles), ceramic conductive particles such as those of tungsten carbide, titanium nitride, zirconium nitride, titanium carbide, titanium boride and molybdenum silicide, and conductive potassium titanate whiskers disclosed in JP-A's 8-31554 and 9-27383. The amount of such conductive particles should preferably be up to 25% by weight of the conductive particles having spiky protuberances.

Any kind of water-insoluble organic compounds can be used when they should be insoluble in water. For instance, either low-molecular organic compounds or polymers may be used.

Preferably but not exclusively, a water-insoluble, low-molecular organic compound that is solid at normal temperature (of about 25° C.) and has a molecular weight of up to about 1,000, and especially 200 to 800 may be used in the invention. However, the low-molecular organic compound should preferably have a melting point, mp, of 40 to 100° C.

Such a water-insoluble, low-molecular organic compound, for instance, includes waxes (e.g., petroleum waxes such as paraffin wax and microcrystalline wax as well as natural waxes such as vegetable waxes, animal waxes and mineral waxes), and fats and oils (e.g., fats, and those called solid fats). Actual components of the waxes, and fats and oils may be hydrocarbons (e.g., an alkane type straight-chain hydrocarbon having 22 or more carbon atoms), fatty acids (e.g., a fatty acid of an alkane type straight-chain hydrocarbon having 12 or more carbon atoms), fatty esters (e.g., a methyl ester of a saturated fatty acid obtained from a saturated fatty acid having 20 or more carbon atoms and a lower alcohol such as methyl alcohol), fatty amides (e.g., an amide of an unsaturated fatty amide such as oleic amide, and erucic amide), aliphatic amines (e.g., an aliphatic primary amine having 16 or more carbon atoms), and higher alcohols (e.g., an n-alkyl alcohol having 16 or more carbon atoms) However, these components may be used by themselves as the low-molecular organic compound.

For the water-insoluble, low-molecular organic compound, preference is given to a wax, or a compound having a hydrogen-bondable functional group, with the compound having a hydrogen-bondable functional group being most preferable, because a uniform dispersion state can be obtained with ease. The use of a hydrocarbon, especially a petroleum wax composed mainly of hydrocarbons makes uniform dispersion difficult. As a consequence, a separation of the low-molecular compound is likely to occur during pressing. The compound having a hydrogen-bondable functional group is bonded to the ether oxygen in the polyalkylene oxide via hydrogen. In other words, the separation of the low-molecular compound is unlikely to occur. For the hydrogen-bondable functional group, an amino group is mentioned. However, a carbamoyl or hydroxyl group is preferred for this purpose.

These low-molecular organic compounds are commercially available, and commercial products may be immediately used. The low-molecular organic compounds may be used alone or in combination of two or more.

Such a low-molecular organic compound, for instance, includes paraffin waxes (e.g., tetracosane $C_{24}H_{50}$ mp 49–52° C.; hexatriacontane $C_{36}H_{74}$ mp 73° C.; HNP-10 mp 75° C., Nippon Seiro Co., Ltd.; and HNP-3 mp 66° C., Nippon Seiro Co., Ltd.), microcrystalline waxes (e.g., Hi-Mic-1080 mp 83° C., Nippon Seiro Co., Ltd.; Hi-Mic-1045 mp 70° C., Nippon Seiro Co., Ltd.; Hi-Mic-2045 mp 64° C., Nippon Seiro Co., Ltd.; Hi-Mic-3090 mp 89° C., Nippon Seiro Co., Ltd.; Seratta 104 mp 96° C., Nippon Sekiyu Seisei Co., Ltd.; and 155 Microwax mp 70° C., Nippon Sekiyu Seisei Co., Ltd.), fatty acids (e.g., behenic acid mp 81° C., Nippon Seika Co., Ltd.; stearic acid mp 72° C., Nippon Seika Co., Ltd.; and palmitic acid mp 64° C., Nippon Seika Co., Ltd.), fatty esters (arachic methyl ester mp 48° C., Tokyo Kasei Co., Ltd.), and fatty amides (e.g., oleic amide mp 76° C., Nippon Seika Co., Ltd.). Use may also be made of wax blends which comprise paraffin waxes and resins and may further contain microcrystalline waxes, and which have a melting point between 40° C. and 100° C.

The water-insoluble polymer used herein is a polymer having a water absorption rate (ASTM D570) of up to 0.5%, and includes thermoplastic polymers such as polyethylene, polystyrene, polymethyl methacrylate, polyvinyl chloride and olefinic copolymers, thermoplastic elastomers, and thermosetting resins such as epoxy resin, phenol resin, unsaturated polyester resin and silicone resin. Among others, preference is given to polyethylene, especially low-density polyethylene.

By the term "low-density polyethylene" is herein intended a polyethylene having a density of 0.910 to 0.929 g/cm$^3$. The low-density polyethylene is produced by a high pressure process, i.e., a high-pressure radical polymerization process carried out at a pressure of at least 1,000 atm., and contains a long-chain branch in addition to a short-chain branch such as an ethylene group.

The water-insoluble polymer, preferably the low-density polyethylene should preferably have a melt flow rate (MFR) of 0.1 to 30 g/10 min., and especially 1.0 to 10 g/10 min., as measured according to the ASTM D1238 definition. At a higher melt flow rate, it is difficult to keep the dispersion of the conductive particles constant due to too low a melt viscosity, and so variations in the resistance value of the thermistor tend to become large. At a lower melt flow rate, too high a melt viscosity causes the chain form of conductive particle structure preferably used in the invention to be cleaved, and so the rate of resistance change of the thermistor tends to decrease.

For the water-insoluble polymer it is thus preferable to use only a low-density polyethylene having an MFR of 0.1 to 30 g/10 min.

The water-insoluble organic compounds may be used alone or in combination of two or more. In the invention, it is acceptable to use the water-insoluble, low-molecular organic compound alone or the water-insoluble polymer alone, or use them in combination.

The organic positive temperature coefficient thermistor of the invention is considered to be present in an islands-sea structure where the polyalkylene oxide and the water-insoluble organic compounds (the water-insoluble, low-molecular organic compound and water-insoluble polymer) are discretely dispersed.

Referring to the mixing ratio between the polyalkylene oxide and the water-insoluble organic compound, it is preferable that the water-insoluble organic compound is used at a ratio of 0.02 to 2.0 (by weight) per the polyalkylene oxide. More exactly, the water-insoluble, low-molecular organic compound should preferably be used at a ratio of 0.02 to 0.4, and especially 0.05 to 0.3 (by weight) per the polyalkylene oxide, and the water-insoluble polymer should preferably be used at a ratio of 0.25 to 2.0, and especially 1.0 to 1.8 (by weight) per the polyalkylene oxide. When this ratio becomes low or the amount of the water-insoluble organic compound becomes too small, any improvement in the humidity resistance of the thermistor element is not found. When this ratio becomes high or the amount of the water-insoluble organic compound becomes too large, on the contrary, any sufficient increase in the resistance of the thermistor element is not obtained at the melting point of the polyalkylene oxide, with a decrease in the strength of the thermistor element. When the water-insoluble organic compounds are used in combination of two or more, too, the total amount of these should preferably come within the aforesaid range.

The amount of the conductive particles should preferably be 2 to 5 times as large as the total weight of the polyalkylene oxide and the water-insoluble organic compound. When the amount of the conductive particles is smaller than this, it is impossible to make the initial resistance of the thermistor element in its non-operating state sufficiently low. When the amount of the conductive particles is larger than this, it is not only difficult to carry out milling but there is also a decreases in the rate of resistance change of the thermistor element upon transition from its non-operating state to its operating state.

If required, the thermistor may contain various additives. For the additives, antioxidants such as phenols, organic sulfurs and phosphites (based on organic phosphorus), and blending aids for polymers (compatibilizing agents) may be used to prevent thermal degradation of the low-molecular organic compound. For the blending aids, agents having polyether side chains bonded to an ethylene oligomer skeleton may be used. The additives may be used alone or in combination of two or more. The content of the additives should preferably be of the order of 0.1 to 10% by weight of the total amount of the polyalkylene oxide and the water-insoluble organic compound.

The organic thermistor of the invention may additionally contain the following various additives provided that they should be not detrimental to the performance thereof.

The thermistor of the invention may contain as a good heat- and electricity-conducting additive silicon nitride, silica, alumina and clay (mica, talc, etc.) described in JP-A 57-12061, silicon, silicon carbide, silicon nitride, beryllia and selenium described in JP-B 7-77161, inorganic nitrides and magnesium oxide described in JP-A 5-217711, and the like.

For robustness improvements, the thermistor of the invention may contain titanium oxide, iron oxide, zinc oxide, silica, magnesium oxide, alumina, chromium oxide, barium sulfate, calcium carbonate, calcium hydroxide and lead oxide described in JP-A 5-226112, inorganic solids having a high relative dielectric constant described in JP-A 6-68963, for instance, barium titanate, strontium titanate and potassium niobate, and the like.

For voltage resistance improvements, the thermistor of the invention may contain boron carbide described in JP-A 4-74383, etc.

For strength improvements, the thermistor of the invention may contain hydrated alkali titanate described in JP-A 5-74603, titanium oxide, iron oxide, zinc oxide and silica described in JP-A 8-17563, etc.

As a crystal nucleator, the thermistor of the invention may contain alkali halide and melamine resin described in JP-B 59-10553, benzoic acid, dibenzylidenesorbitol and metal benzoates described in JP-A 6-76511, talc, zeolite and dibenzylidenesorbitol described in JP-A 7-6864, sorbitol derivatives (gelling agents), asphalt and sodium bis(4-t-butylphenyl) phosphate described in JP-A 7-263127, etc.

As an arc-controlling agent, the thermistor of the invention may contain alumina and magnesia hydrate described in JP-B 4-28744, metal hydrates and silicon carbide described in JP-A 61-250058, etc.

As a preventive for the harmful effects of metals, the thermistor of the invention may contain Irganox MD1024 (Ciba-Geigy) described in JP-A 7-6864, etc.

As a flame retardant, the thermistor of the invention may contain diantimony trioxide and aluminum hydroxide described in JP-A 61-239581, magnesium hydroxide described in JP-A 5-74603, a halogen-containing organic compound (including a polymer) such as 2,2-bis(4-hydroxy-3,5-dibromophenyl)propane and polyvinylidene fluoride (PVDF), a phosphorus compound such as ammonium phosphate, etc.

In addition to these additives, the thermistor of the invention may contain zinc sulfide, basic magnesium carbonate, aluminum oxide, calcium silicate, magnesium silicate, aluminosilicate clay (mica, talc, kaolinite, montmorillonite, etc.), glass powders, glass flakes, glass fibers, calcium sulfate, etc.

The content of these additives should preferably be up to 25% by weight of the total weight of the polymer matrix, low-molecular organic compound and conductive particles.

In the practice of the invention, the polyalkylene oxide and conductive particles, and the polyalkylene oxide, conductive particles and water-insoluble organic compound may be milled together in known manners using, e.g., a mill or roll for a period of about 5 to 90 minutes. The milling temperature should usually be higher than the melting point of the polymer, and preferably the melting point plus 5 to 40° C.

With the help of a solution process, it is acceptable that the polyalkylene oxide and conductive particles, or the polyalkylene oxide, conductive particles and water-insoluble organic compound are mixed together. In this case, there are available a process for dispersing the water-insoluble organic compound and conductive particles using a solvent in which the polyalkylene oxide is soluble, a process for dispersing the polyalkylene oxide and conductive particles using a solvent in which the water-insoluble organic compound is soluble, a process for dispersing the conductive particles using a solvent in which both the polyalkylene oxide and the water-insoluble organic compound are soluble, etc.

The milled mixture of the polyalkylene oxide, conductive particles and water-insoluble organic compound is pressed into a sheet having a given thickness, and metal electrodes are thereafter thermocompressed onto the sheet to prepare a thermistor element. Press molding may be carried out by an injection process, an extrusion process, and the like. The metal electrodes are preferably made of Cu, Ni, etc. The press molding may be carried out simultaneously with electrode formation.

After press molding, a crosslinking treatment may be carried out if required. The crosslinking may be achieved by a radiation crosslinking process, a chemical crosslinking process using an organic peroxide, a water crosslinking process where a silane coupling agent is grafted for a condensation reaction of a silanol group, and the like.

The organic positive temperature coefficient thermistor according to the invention can be operated at less than 100°

C., and preferably 60 to 90° C., and have low initial resistance in its non-operating state as represented by a room-temperature specific resistance value of about $10^{-2}$ to $10^{0}$ Ω·cm, with a large rate of resistance change of 6 orders of magnitude greater upon transition from its non-operating state to its operating state. In addition, this thermistor is excellent in humidity resistance, and so has a humidity-depending operating life of 20 years or longer at Tokyo, and 10 years or longer at Naha.

EXAMPLE

The present invention will now be explained more specifically with reference to examples, and comparative examples.

Example 1

Polyethylene oxide (made by Sumitomo Seika Co., Ltd. with a weight-average molecular weight of 4,300,000 to 4,800,000 and a melting point of 67° C.) was used as the crystalline polymer, oleic amide (Newtron P made by Nippon Seika Co., Ltd.) as the water-insoluble, low-molecular organic compound, and a filamentary nickel powders in chain form (Type 255 Nickel Powder made by INCO Co., Ltd.) as the conductive particles. The conductive particles had an average particle diameter of 2.2 to 2.8 μm, an apparent density of 0.5 to 0.65 g/cm$^3$, and a specific surface area of 0.68 m$^2$/g.

The polyethylene oxide was milled with 20% by weight of oleic amide, the nickel powders at a weight of four times as large as the polyethylene oxide and 0.5% by weight of phenolic and organic sulfur antioxidants (Sumilizer BHT and Sumilizer TP-D made by Sumitomo Chemical Co., Ltd.) in a mill at 80° C. for 10 minutes.

Thirty (30)-μm thick Ni foil electrodes were compressed to both sides of the thus milled mixture, and the milled structure was pressed to obtain a pressed sheet having a total thickness of 1 mm. Then, this sheet was punched out into a disk form of 10 mm in diameter to obtain a thermistor element, a section of which is shown in FIG. 1. As shown in FIG. 1, a thermistor element sheet 12 that was a milled molded sheet containing the crystalline polymer, conductive particles and water-insoluble organic compound was sandwiched between electrodes 11 formed of Ni foils.

Figure 2:
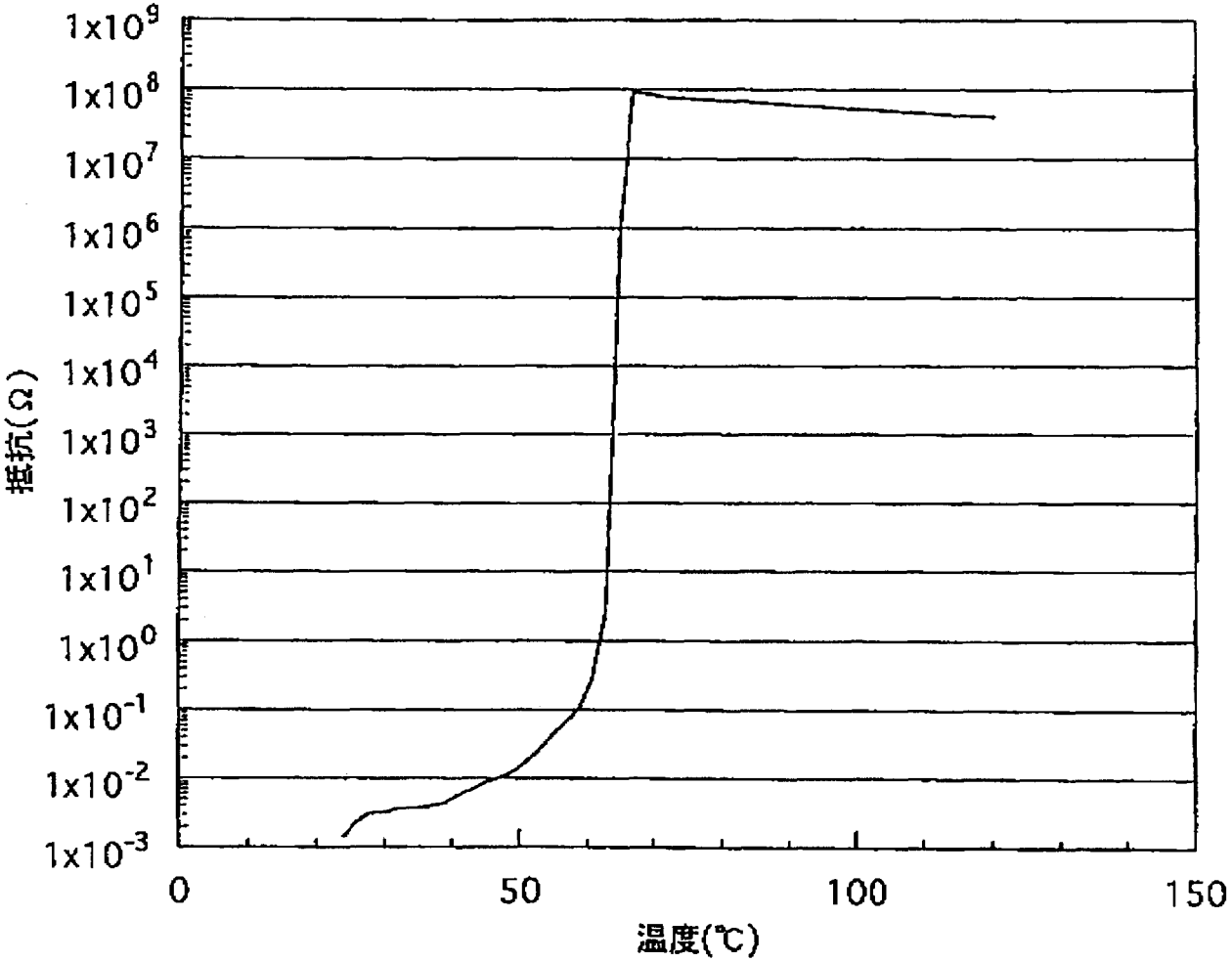
FIG. 2 is a temperature vs. resistance curve for a sample obtained in Example 1.

The element was heated and cooled in a thermostat, and measured for resistance value at a given temperature by the four-terminal method to obtain a temperature vs. resistance curve. The results are plotted in FIG. 2.

The resistance value at room temperature (25° C.) was $3\times10^{-3}$ Ω ($2.3\times10^{-2}$ Ω·cm) with a sharp resistance rise at around 67° C. or the melting point of polyethylene oxide, and the maximum resistance value was $8.9\times10^{7}$ Ω ($7.0\times10^{8}$ Ω·cm) The rate of resistance change was 10.5 orders of magnitude.

Humidity Resistance Testing

Figure 3:
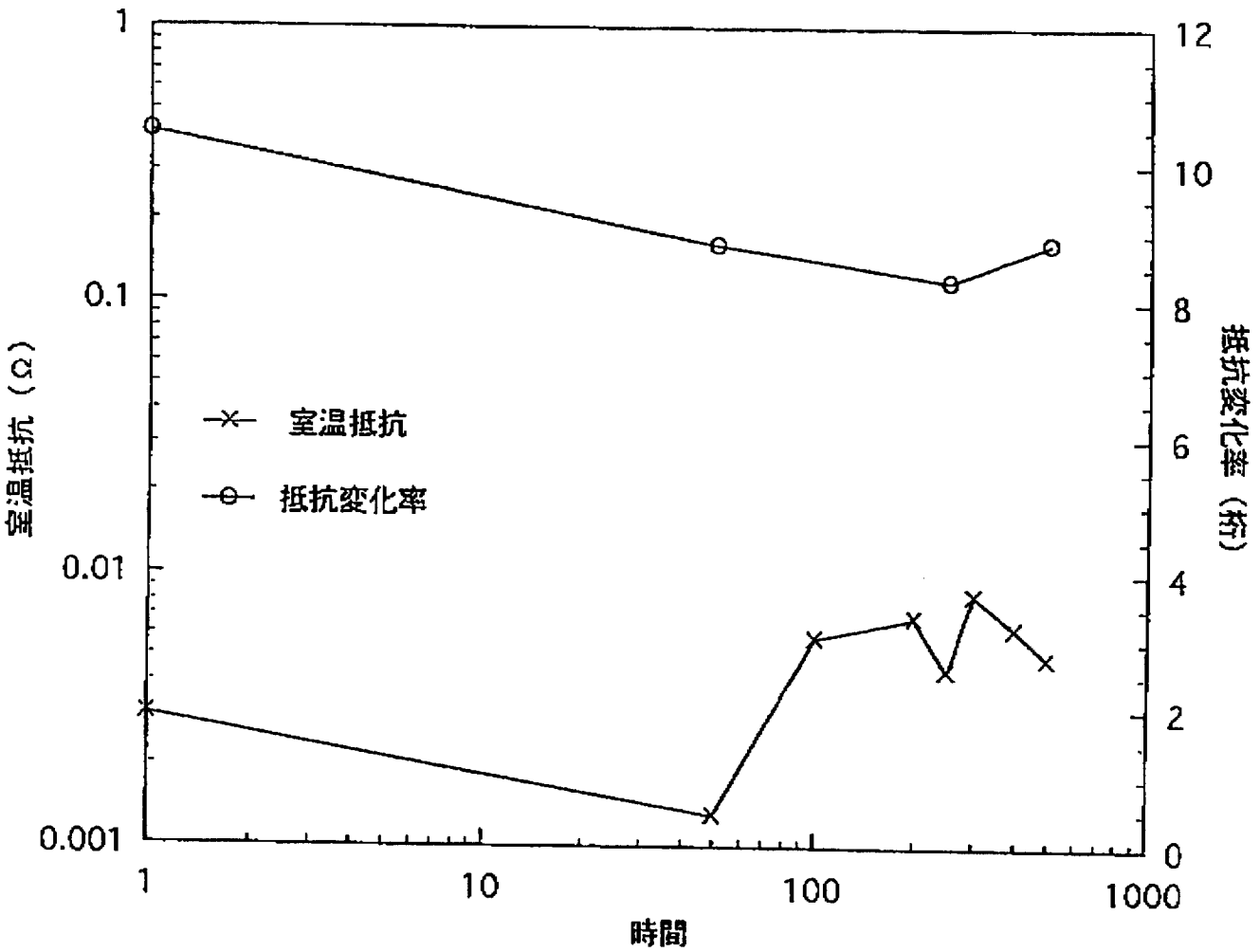
FIG. 3 is a graph illustrating the room-temperature resistance and rate of resistance change of the sample of Example 1 at varying times when allowed to stand alone in humidity resistance testing at 80° C. and 80% RH.

This element was allowed to stand alone in a combined thermostat and humidistat preset at 80° C. and 80% RH for humidity resistance testing. FIG. 3 is a graph illustrating the room-temperature resistance and the rate of resistance change at some testing times. Until the elapse of 500 hours, the resistance value at room temperature (25° C.) was kept at $1\times10^{-2}$ Ω ($7.9\times10^{-2}$ Ω·cm) or lower while the rate of resistance change was 8 orders of magnitude greater; sufficient PTC performance was well maintained.

The 500-hour humidity resistance testing at 80° C. and 80% RH is tantamount to a humidity-dependent operating life of 20 years or longer at Tokyo, and a humidity-dependent operating life of 10 years or longer at Naha, as calculated on an absolute humidity basis. The calculation on an absolute humidity basis is explained with reference to the conversion from the operating life under 80° C. and 80% RH conditions to the operating life under 25° C. and 60% RH conditions. The absolute humidity at 80° C. and 80% RH is 232.5 g/m$^3$ while the absolute humidity at 25° C. and 60% RH is 13.8 g/m$^3$. Here assume the acceleration constant is 2. Then, $(232.5/13.8)^2$ is approximately equal to 283.85. If, in this case, the operating life is 500 hours under the 80° C. and 80% RH conditions, then the operating life under the 25° C. and 60% RH conditions is 500 hours×283.85=141,925 hours≈5,914 days≈16.2 years It is here to be noted that the year-round humidity at Tokyo, and Naha is given by the sum of each average month-long relative humidity as calculated on an absolute humidity basis.

Example 2

A sample was obtained as in Example 1 with the exception that erucic amide (Newtron S made by Nippon Seika Co., Ltd.) was used as the water-insoluble, low-molecular organic compound. A temperature vs. resistance curve was obtained and humidity resistance testing was carried out as in Example 1.

This sample had a resistance value of $5\times10^{-3}$ Ω ($3.9\times10^{-2}$ Ω·cm) at room temperature (25° C.), and showed a sharp resistance rise at around 67° C. or the melting point of polyethylene oxide with a maximum resistance value of $9.2\times10^{6}$ Ω ($7.2\times10^{7}$ Ω·cm) and a rate of resistance change of 9.3 orders of magnitude.

In the 80° C. and 80% RH humidity resistance testing, the room-temperature resistance value was $8\times10^{-3}$ Ω ($6.3\times10^{-2}$ Ω·cm) after the elapse of 500 hours, with the rate of resistance value being 7.5 orders of magnitude. Thus, sufficient PTC performance was well maintained.

Example 3

A sample was obtained as in Example 1 with the exception that microcrystalline wax (Hi-Mic-1045 made by Nippon Seiro Co., Ltd.) was used as the water-insoluble, low-molecular organic compound, and the following compatibilizing agent I (Sumiade 300 made by Sumitomo Chemical Co., Ltd.) was used in an amount of 2% by weight of the total weight of polyethylene oxide and microcrystalline wax. A temperature vs. resistance curve was obtained and humidity resistance testing was carried out as in Example 1.

Compatibilizing Agent I

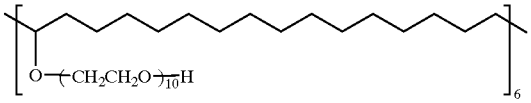

This sample had a resistance value of $2\times10^{-3}$ Ω ($1.6\times10^{-2}$ Ω·cm) at room temperature (25° C.), and showed a sharp resistance rise at around 67° C. or the melting point of polyethylene oxide with a maximum resistance value of $8.0\times10^{7}$ Ω ($6.3\times10_{8}$ Ω·cm) and a rate of resistance change of 10.6 orders of magnitude.

In the 80° C. and 80% RH humidity resistance testing, the room-temperature resistance value was $7\times10^{-3}$ Ω ($5.5\times10^{-2}$ Ω·cm) after the elapse of 500 hours, with the rate of resistance value being 8.3 orders of magnitude. Thus, sufficient PTC performance was well maintained.

Example 4

A sample was obtained as in Example 1 with the exception that behenic acid (made by Nippon Seika Co., Ltd.) was used as the water-insoluble, low-molecular organic compound. A temperature vs. resistance curve was obtained and humidity resistance testing was carried out as in Example 1.

This sample had a resistance value of $3\times10^{-3}$ Ω ($2.3\times10^{-2}$ Ω·cm) at room temperature (25° C.), and showed a sharp resistance rise at around 67° C. or the melting point of polyethylene oxide with a maximum resistance value of $7.2\times10^{6}$ Ω ($5.7\times10^{7}$ Ω·cm) and a rate of resistance change of 9.4 orders of magnitude.

In the 80° C. and 80% RH humidity resistance testing, the room-temperature resistance value was $9\times10^{-3}$ Ω ($7.1\times10^{-2}$ Ω·cm) after the elapse of 500 hours, with the rate of resistance value being 7.7 orders of magnitude. Thus, sufficient PTC performance was well maintained.

Example 5

Added to the same polyethylene oxide as in Example 1 were phenolic and organic sulfur antioxidants (Sumilizer BHT and Sumilizer TP-D made by Sumitomo Chemical Co., Ltd.) in an amount of 0.5% by weight of polyethylene oxide and the same compatibilizing agent I as in Example 3 in an amount of 5% by weight of polyethylene oxide, and the blend was milled at 80° C. in a mill for 10 minutes. In the mill brought up to a temperature of 115° C., low-density polyethylene (LC500 made by Nippon Polychem Co., Ltd. with an MFR of 4.0 g/10 min. and a melting point of 106° C.) as the water-insoluble polymer was then added to the milled mixture in an amount of 1.75 times as large as the weight of polyethylene oxide for a 5-minute milling. Then, the same filamentary nickel powders in chain form as in Example 1 were added to the milled mixture in an amount of 4 times as large as the total weight of polyethylene oxide and low-density polyethylene for a 60-minute milling at 115° C. in the mill. Finally, Ni foils were thermocompressed to this milled mixture as in Example 1 to obtain a thermistor element.

Figure 4:
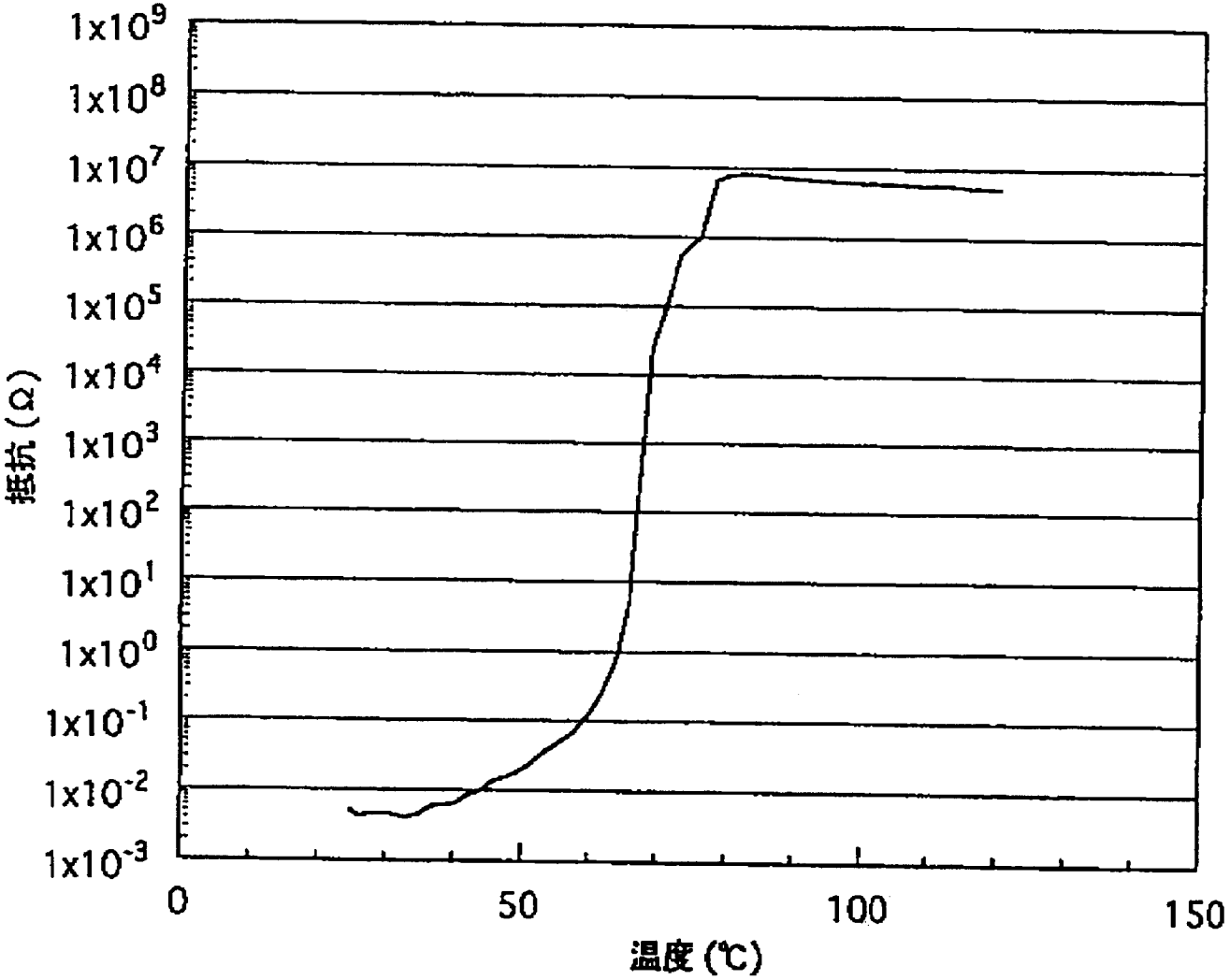
FIG. 4 is a temperature vs. resistance curve for a sample obtained in Example 5.

A temperature vs. resistance curve was obtained for this sample as in Example 1. The results are plotted in FIG. 4. The resistance value at room temperature (25° C.) was $5\times10^{-3}$ Ω ($3.9\times10^{-2}$ Ω·cm) with a sharp resistance rise at around 67° C. or the melting point of polyethylene oxide, a maximum resistance value of $8\times10^{6}$ Ω ($6.3\times10^{7}$ Ω·cm) and a rate of resistance change of 9.2 orders of magnitude.

Figure 5:
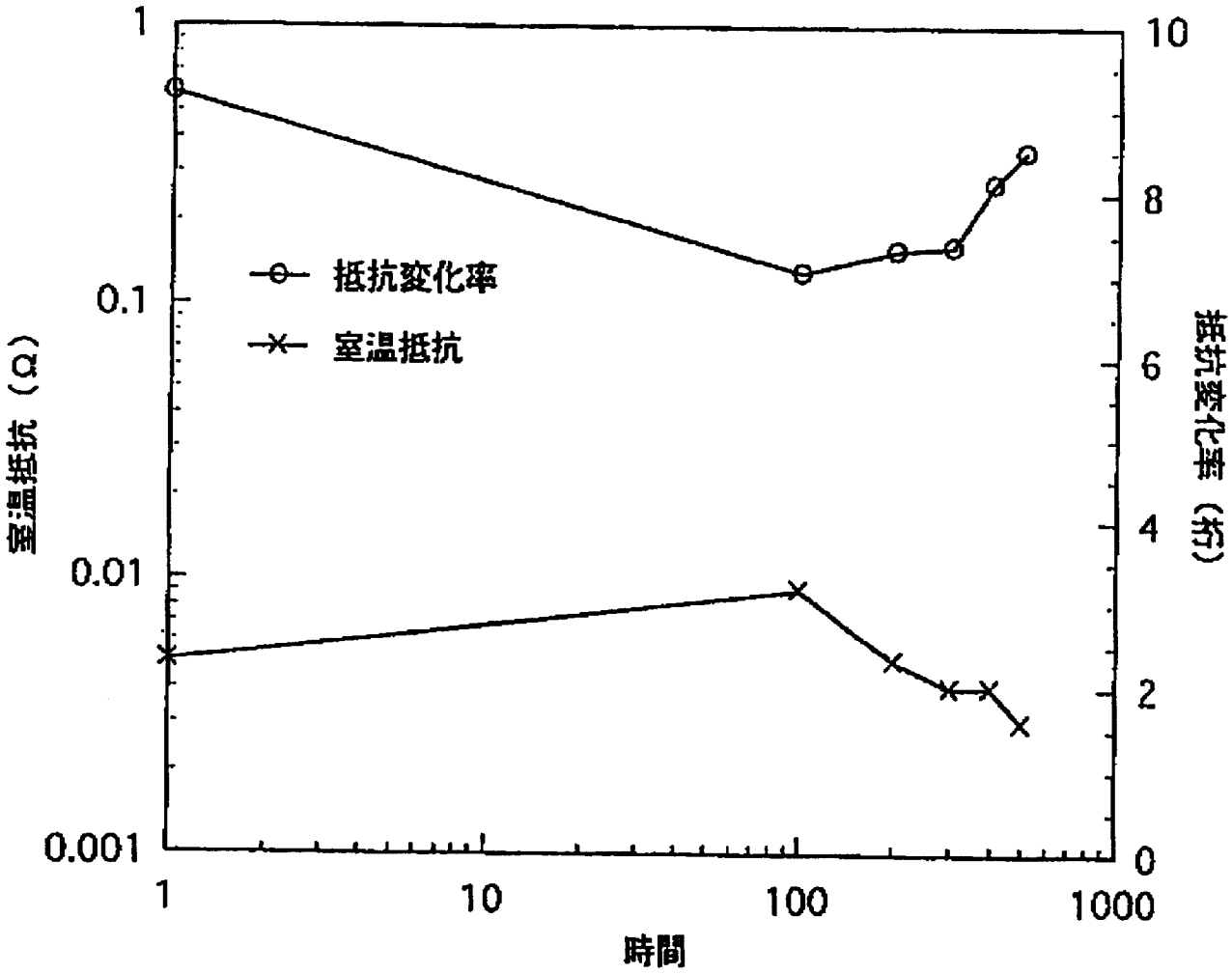
FIG. 5 is a graph illustrating the room-temperature resistance and rate of resistance change of the sample of Example 5 at varying times when allowed to stand alone in humidity resistance testing at 80° C. and 80% RH.

This sample was tested for humidity resistance as in Example 1. The room-temperature resistance and the rate of resistance change at some testing times are plotted in FIG. 5. Until the passage of 500 hours the room-temperature (25° C.) resistance value was kept at $1\times10^{-2}$ Ω ($7.9\times10^{-2}$ Ω·cm) or lower and the rate of resistance change remained at 7 orders of magnitude greater. Thus, sufficient PTC performance was well maintained.

Example 6

A sample was obtained as in Example 5 with the exception that an ethylene-vinyl acetate copolymer (LV241 made by Nippon Polychem Co., Ltd. with an vinyl acetate content of 8.0 wt %, an MFR of 1.5 g/10 min. and a melting point of 99° C.) as the water-insoluble polymer was added to polyethylene oxide in an amount of 1.5 times as large as the weight thereof and the mill temperature was changed to 110° C. Then, a temperature vs. resistance curve was obtained and humidity resistance testing was carried out as in Example 5.

This sample had a room-temperature (25° C.) resistance value of $9\times10^{-3}$ Ω ($7.1\times10^{-2}$ Ω·cm), and showed a sharp resistance rise at around 67° C. or the melting point of polyethylene oxide with a maximum resistance value of $2\times10^{7}$ Ω ($1.6\times10^{8}$ Ω·cm) and a rate of resistance change of 9.3 orders of magnitude. Until the elapse of 500 hours in the humidity resistance testing, the room-temperature resistance as kept at $1.5\times10^{-2}$ Ω ($1.2\times10^{-1}$ Ω·cm) or lower and the rate of resistance change remained at 6 orders of magnitude greater. Thus, sufficient PTC performance was well maintained.

Example 7

A sample was obtained as in Example 5 with the exception that the conductive particles were changed to a filamentary nickel powders in chain form II (INCO Type 287 Nickel Powder made by INCO Co., Ltd. with an average particle size of 2.6 to 3.3 μm, an apparent density of 0.75 to 0.95 g/cm$^3$ and a specific surface area of 0.58 m$^2$/g). Then, a temperature vs. resistance curve was obtained and humidity resistance testing was carried out as in Example 1.

This sample had a room-temperature (25° C.) resistance value of $7\times10^{-3}$ Ω ($5.5\times10^{-2}$ Ω·cm), and showed a sharp resistance rise at around 67° C. or the melting point of polyethylene oxide with a maximum resistance value of $8\times10^{6}$ Ω ($6.3\times10^{7}$ Ω·cm) and a rate of resistance change of 9.1 orders of magnitude. Until the elapse of 500 hours in the humidity resistance testing, the room-temperature resistance was kept at $1\times10^{-2}$ Ω ($7.9\times10^{-2}$ Ω·cm) or lower and the rate of resistance change remained at 6.5 orders of magnitude greater. Thus, sufficient PTC performance was well maintained.

Example 8

A sample was obtained as in Example 5 with the exception that the crystalline polymer was changed to polyethylene oxide II (made by Sumitomo Seika Co., Ltd. with a weight-average molecular weight of 3,300,000 to 3,800,000 and a melting point of 67° C.). Then, a temperature vs. resistance curve was obtained and humidity resistance testing was carried out as in Example 1.

This sample had a room-temperature (25° C.) resistance value of $6\times10^{-3}$ Ω ($4.7\times10^{-2}$ Ω·cm), and showed a sharp resistance rise at around 67° C. or the melting point of polyethylene oxide with a maximum resistance value of $8\times10^{6}$ Ω ($6.3\times10^{7}$ Ω·cm) and a rate of resistance change of 9.1 orders of magnitude. Until the elapse of 500 hours in the humidity resistance testing, the room-temperature resistance was kept at $1\times10^{-2}$ Ω ($7.9\times10^{-2}$ Ω·cm) or lower and the rate of resistance change remained at 7 orders of magnitude greater. Thus, sufficient PTC performance was well maintained.

Comparative Example 1

Added to the same polyethylene oxide as in Example 1 were the same phenolic and organic sulfur antioxidants as in Example 1 in an amount of 0.5% by weight of polyethylene oxide and the same filamentary nickel powders in chain form as in Example 1 in an amount of 4 times as large as the weight of polyethylene oxide, and the blend was milled together at 80° C. in a mill for 10 minutes. As in Example 1, Ni electrodes were compressed to both surfaces of the milled mixture to obtain a sample.

A temperature vs. resistance curve for this sample was obtained as in Example 1. The sample had a room-temperature (25° C.) resistance value of $6\times10^{-3}$ Ω ($4.7\times10^{-2}$ Ω·cm), and showed a sharp resistance rise at around 67° C. or the melting point of the polyethylene oxide with a maximum resistance value of $6.0\times10^{7}$ Ω ($4.7\times10^{8}$ Ω·cm) and a rate of resistance change of 10.0 orders of magnitude.

Figure 6:
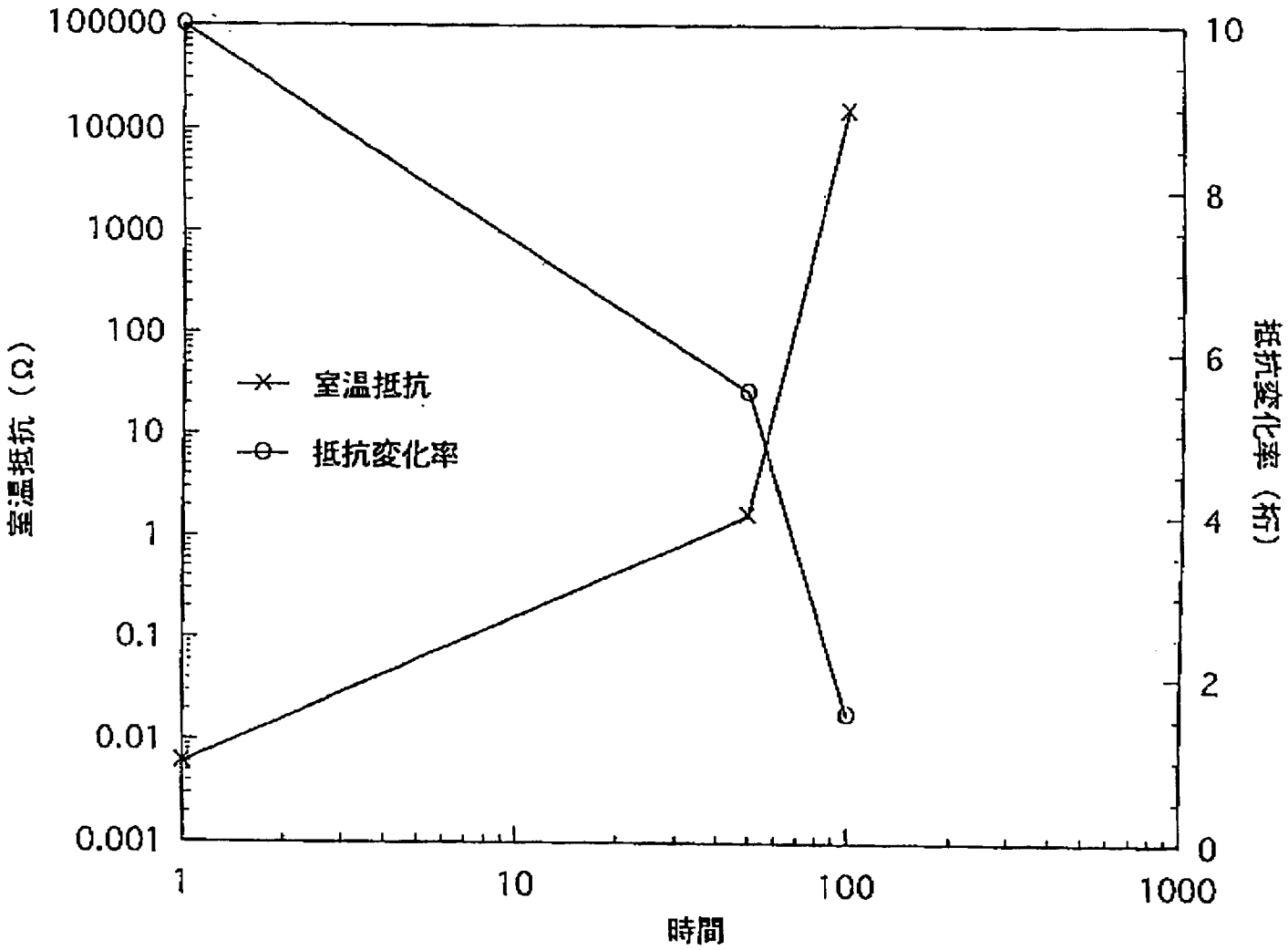
FIG. 6 is a graph illustrating the room-temperature resistance and rate of resistance change of a sample obtained in Comparative Example 1 at varying times when allowed to stand alone in humidity resistance testing at 80° C. and 80% RH.

As in Example 1, this sample was tested for humidity resistance at 80° C. and 80% RH. The room-temperature resistance and the rate of resistance change of the sample at some testing times are plotted in FIG. 6. Within 50 hours, the room-temperature (25° C.) resistance value increased by 2 orders of magnitude greater while the rate of resistance decreased to 6 orders of magnitude or less. Within 100 hours, the room-temperature resistance value increased from the initial value to 6 orders of magnitude greater while the rate of resistance change decreased to 2 orders of magnitude or less. Thus, considerable degradation in performance was found within as short as 50 hours.

The organic positive temperature coefficient thermistor of the invention containing the water-insoluble organic compound together with polyethylene oxide substantially maintains the excellent PTC performance that the conductive particle (having spiky protuberances)-polyethylene oxide base organic thermistor can have, i.e., the operating temperature of 60 to 70° C., the low initial resistance (at room temperature) in the non-operating state, and the large rate of resistance change upon transition from the non-operating state to the operating state. In addition, the humidity resistance of the thermistor is greatly improved.

Example 9

Polypropylene oxide (having a weight-average molecular weight of 1,000 and a melting point of 70° C.) was used as the crystalline polymer, oleic amide (Newtron P made by Nippon Seika Co., Ltd.) as the water-insoluble, low-molecular organic compound, and the same filamentary nickel powders in chain form as in Example 1 was used for the conductive particles.

Added to the polypropylene oxide were the oleic amide in an amount of 10% by weight of polypropylene oxide, the nickel powders in an amount of 4 times as large as the weight of polypropylene oxide and phenolic and organic sulfur antioxidants (Sumilizer BHT and Sumilizer TP-D made by Sumitomo Chemical Co., Ltd.) in an amount of 0.5% by weight of polypropylene oxide. The blend was milled together at 80° C. in a mill for 10 minute. As in Example 1, Ni foils were thermocompressed to the milled mixture to obtain Et thermistor element.

Figure 7:
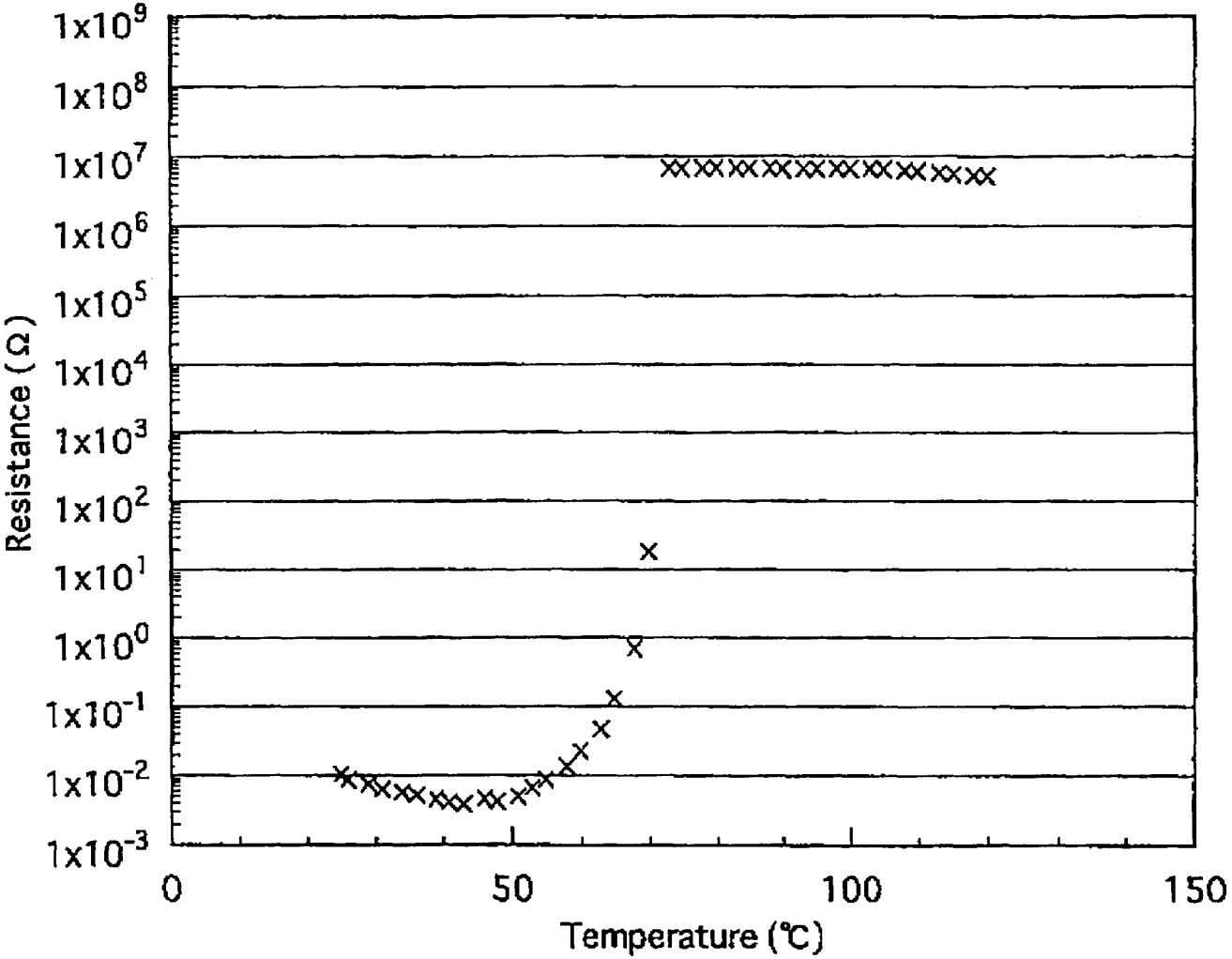
FIG. 7 is a temperature vs. resistance curve for a sample obtained in Example 9.

As in Example 1, a temperature vs. resistance curve for this sample was obtained. The results are plotted in FIG. 7. The sample had a room-temperature (25° C.) resistance value of $7.6\times10^{-3}$ Ω ($6.0\times10^{-2}$ Ω·cm), and showed a sharp resistance rise at around 70° C. or the melting point of polypropylene oxide, with a maximum resistance value of $6.5\times10^{6}$ Ω ($5.1\times10^{7}$ Ω·cm) and a rate of resistance change of 8.9 orders of magnitude.

Figure 8:
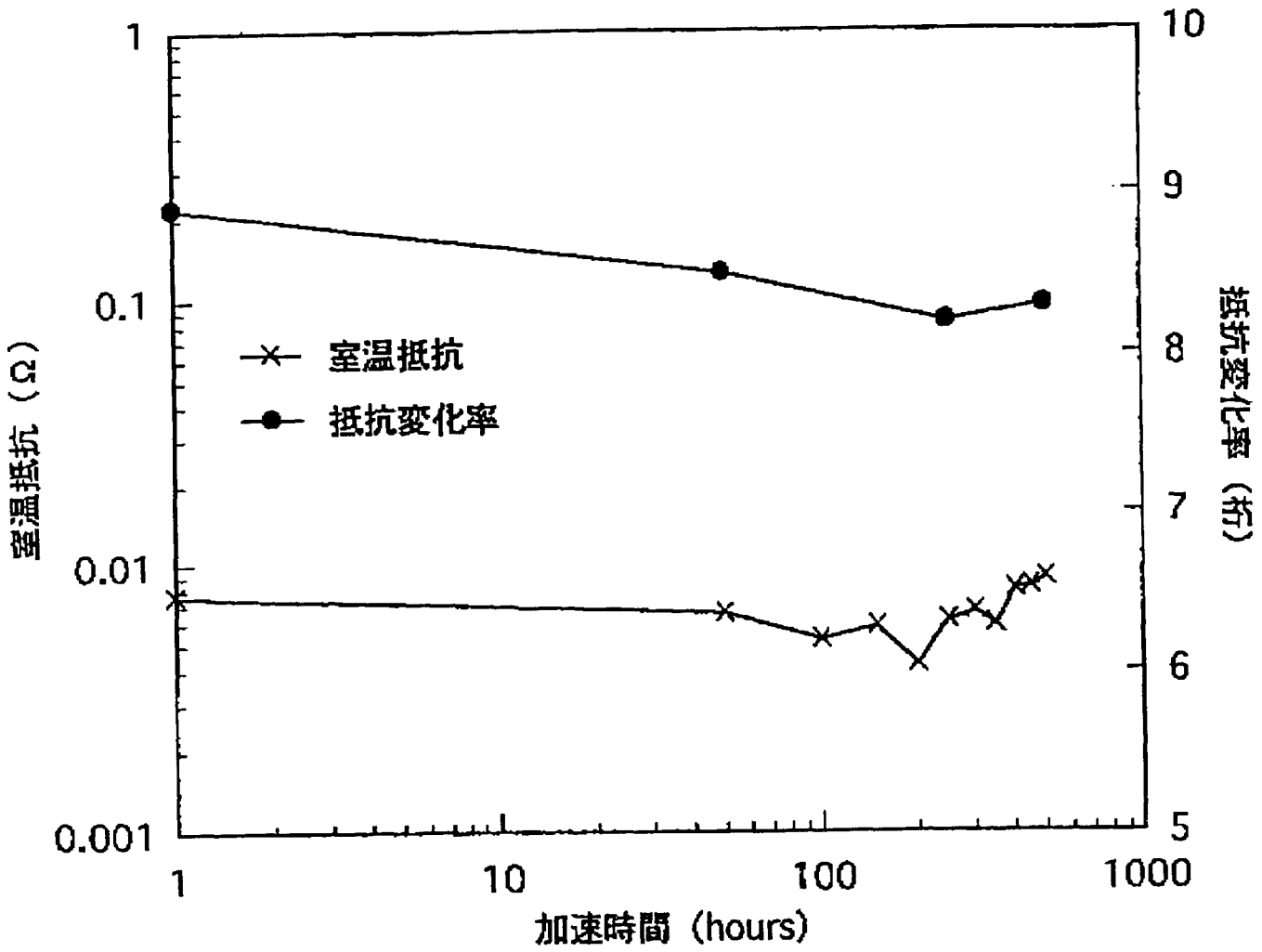
FIG. 8 is a graph illustrating the room-temperature resistance and rate of resistance change of the sample of Example 9 at varying times when allowed to stand alone in humidity resistance testing at 80° C. and 80% RH.

As in Example 1, this sample was tested for humidity resistance. The room-temperature resistance and the rate of resistance change at some testing times are plotted in FIG. 8. Until the passage of 500 hours, the room-temperature (25° C.) resistance value was kept at $1\times10^{-2}$ Ω ($7.9\times10^{-2}$ Ω·cm) or less while the rate of resistance change remained at 8 orders of magnitude greater. Thus, sufficient PTC performance was well maintained.

Example 10

A thermistor element was obtained as in Example 9 with the exception that microcrystalline wax (Hi-Mic-1045 made by Nippon Seiro Co., Ltd.) in an amount of 10% by weight of polypropylene oxide was used as the oleic amide for the water-insoluble, low-molecular organic compound, and the same compatibilizing agent I as in Example 3 was used in an mount of 2% by weight of the total weight of the polypropylene oxide and microcrystalline wax. A temperature vs. resistance curve was obtained and humidity resistance testing was carried out as in Example 1.

The sample had a room-temperature (25° C.) resistance value of $6.4\times10^{-3}$ Ω ($5.0\times10^{-2}$ Ω·cm), and showed a sharp resistance rise at around 70° C. or the melting point of polypropylene oxide, with a maximum resistance value of $5.2\times10^{6}$ Ω ($4.0\times10^{7}$ Ω·cm) and a rate of resistance change of 8.9 orders of magnitude.

After the passage of 500 hours in the 80° C. and 80% RH humidity resistance testing, the room-temperature resistance value was $8.8\times10^{-3}$ Ω ($6.9\times10^{-2}$ Ω·cm) and the rate of resistance change was 7.9 orders of magnitude. Thus, sufficient PTC performance was well maintained.

Example 11

Added to the same polypropylene oxide as in Example 9 were phenolic and organic sulfur antioxidants (Sumilizer BHT and Sumilizer TP-D made by Sumitomo Chemical Co., Ltd.) in an amount of 0.5% by weight of the polypropylene oxide and the same compatibilizing agent I as in Example 3 in an amount of 5% by weight of polypropylene oxide. The blend was then milled together at 80° C. in a mill for 10 minutes. After the mill had been brought up to a temperature of 115° C., low-density polyethylene (LC500 made by Nippon Polychem Co., Ltd. with an MFR of 4.0 g/10 min. and a melting point of 106° C.) in an amount of 1.5 times as large as the polypropylene oxide was added as the water-insoluble polymer to the milled mixture for a 5-minute milling. Additionally, the same filamentary nickel powders as in Example 1 were added to the milled mixture in an amount of 4 times as large as the total weight of the polypropylene oxide and low-density polyethylene for a 60-minute milling at 115° C. in the mill. As in Example 1, Ni foils were thermocompressed to the milled mixture to obtain a thermistor element. A temperature vs. resistance curve was obtained and humidity resistance testing was carried out as in Example 1.

The sample had a room-temperature (25° C.) resistance value of $5.3\times10^{-3}$ Ω ($4.2\times10^{-2}$ Ω·cm), and showed a sharp resistance rise at around 70° C. or the melting point of polypropylene oxide, with a maximum resistance value of $8.2\times10^{5}$ Ω ($6.4\times10^{6}$ Ω·cm) and a rate of resistance change of 8.2 orders of magnitude.

After the passage of 500 hours in the 80° C. and 80% RH humidity resistance testing, the room-temperature resistance value was $7.6\times10^{-3}$ Ω ($6.0\times10^{-2}$ Ω·cm) and the rate of resistance change was 7.6 orders of magnitude. Thus, sufficient PTC performance was well maintained.

Example 12

A thermistor element was obtained as in Example 9 with the exception that polytetramethylene oxide (having a weight-average molecular weight of 5,000 and a melting point of 60° C.) was used as the polypropylene oxide and milling was carried out at 70° C. A temperature vs. resistance curve was obtained and humidity resistance testing was carried out as in Example 1.

The sample had a room-temperature (25° C.) resistance value of $8.5\times10^{-3}$ Ω ($6.7\times10^{-2}$ Ω·cm), and showed a sharp resistance rise at around 60° C. or the melting point of polytetramethylene oxide, with a maximum resistance value of $4.2\times10^5$ Ω ($3.2\times10^6$ Ω·cm) and a rate of resistance change of 7.7 orders of magnitude.

After the passage of 500 hours in the 80° C. and 80% RH humidity resistance testing, the room-temperature resistance value was $9.1\times10^{-3}$ Ω ($7.1\times10^{-2}$ Ω·cm) and the rate of resistance change was 7.2 orders of magnitude. Thus, sufficient PTC performance was well maintained.

Comparative Example 2

Added to the same polypropylene oxide as in Example 9 were the same phenolic and organic sulfur antioxidants as in Example 9 in an amount of 0.5% by weight of polyethylene oxide and the same filamentary nickel powders in chain form as in Example 1 in an amount of 4 times as large as the weight of polypropylene oxide, and the blend was milled together at 80° C. in a mill for 10 minutes. As in Example 1, Ni electrodes were compressed to both surfaces of the milled mixture to obtain a sample.

A temperature vs. resistance curve for this sample was obtained as in Example 1. The sample had a room-temperature (25° C.) resistance value of $7.1\times10^{-3}$ Ω ($5.6\times10^{-2}$ Ω·cm), and showed a sharp resistance rise at around 70° C. or the melting point of polypropylene oxide with a maximum resistance value of $8.1\times10^6$ Ω ($6.4\times10^7$ Ω·cm) and a rate of resistance change of 9.1 orders of magnitude.

Figure 9:
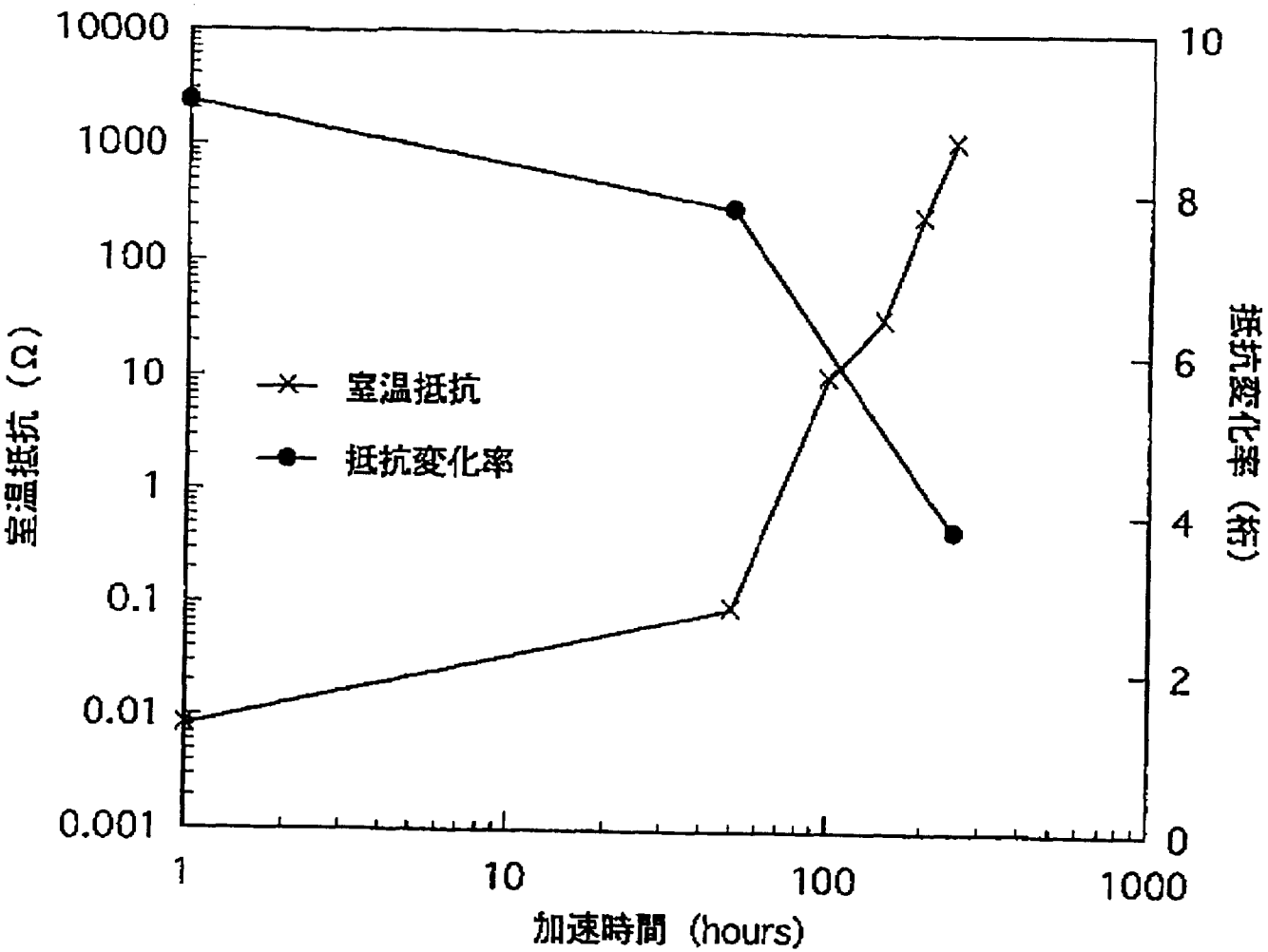
FIG. 9 is a graph illustrating the room-temperature resistance and rate of resistance change of a sample according to Comparative Example 2 at varying times when allowed to stand alone in humidity resistance testing at 80° C. and 80% RH.

As in Example 1, this sample was tested for humidity resistance at 80° C. and 80% RH. The room-temperature resistance and the rate of resistance change of the sample at some testing times are plotted in FIG. 9. Within 50 hours, the room-temperature (25° C.) resistance value increased by 1 order of magnitude greater while the rate of resistance decreased to 8 orders of magnitude or less. The room-temperature resistance value increased from the initial value to 3 orders of magnitude greater with in 100 hours and 5 orders of magnitude greater within 250 hours, while the rate of resistance change decreased to 4 orders of magnitude or less within 250 hours. Thus, considerable degradation in performance was found although not comparable to that in the thermistor of Comparative Example 1 using polyethylene oxide.

The organic positive temperature coefficient thermistor of the invention containing the water-insoluble organic compound substantially maintains the excellent PTC performance that the conductive particle (having spiky protuberances)-polyalkylene oxide base organic thermistor can have, i.e., the operating temperature of less than 100° C., the low initial resistance (at room temperature) in the non-operating state, and the large rate of resistance change upon transition from the non-operating state to the operating state. In addition, the humidity resistance of the thermistor is greatly improved.

When the same polytetramethylene oxide as in Example 12 was used in place of polypropylene oxide in Comparative Example 2, too, the same results as mentioned above were obtained.

EFFECTS OF THE INVENTION

According to the present invention, it is thus possible to provide an organic positive temperature coefficient thermistor that can operate at less than 100° C. not dangerous for the human body, have low initial resistance in a non-operating state (at room temperature) with a large rate of resistance change upon transition from the non-operating state to an operating state, and is much more improved in terms of humidity resistance as well.

What we claim is:

1. An organic positive temperature coefficient thermistor comprising a polyalkylene oxide, provided that the polyalkylene oxide is not a polyethylene oxide homopolymer, and conductive particles, each having spiky protuberances.

2. The organic positive temperature coefficient thermistor according to claim 1, wherein said polyalkylene oxide is polypropylene oxide or polytetramethylene oxide.

3. An organic positive temperature coefficient thermistor comprising a polyalkylene oxide, a water-insoluble organic compound and conductive particles, each having spiky protuberances.

4. The organic positive temperature coefficient thermistor according to claim 3, wherein said polalkylene oxide is polyethylene oxide, polypropylene oxide or polytetramethylene oxide.

5. The organic positive temperature coefficient thermistor according to claim 3, wherein said water-insoluble organic compound is a low-density polyethylene.

6. The organic positive temperature coefficient thermistor according to claim 3, wherein said water-insoluble organic compound is a water-insoluble polymer having a melt flow rate of 0.1 to 30 g/10 min.

7. The organic positive temperature coefficient thermistor according to claim 3, wherein said water-insoluble organic compound is a water-insoluble, low-molecular organic compound having a molecular weight of 1,000 or less.

8. The organic positive temperature coefficient thermistor according to claim 7, wherein said water-insoluble, low-molecular organic compound has a melting point of 40 to 100° C.

9. The organic positive temperature coefficient thermistor according to claim 7, wherein said water-insoluble, low-molecular organic compound is a wax or a compound having a hydrogen-bondable functional group.

10. The organic positive temperature coefficient thermistor according to claim 9, wherein said hydrogen-bondable functional group is a carbamoyl or hydroxyl group.

11. The organic positive temperature coefficient thermistor according to claim 3, wherein said conductive particles, each having spiky protuberances, are interconnected in a chain form.

12. The organic positive temperature coefficient thermistor according to claim 3, which has an operating temperature of less than 100° C.

* * * * *